United States Patent [19]

Itoh

[11] 3,985,297

[45] Oct. 12, 1976

[54] POWDER PAINTING APPARATUS

[75] Inventor: Tsutomu Itoh, Tokyo, Japan

[73] Assignee: Onoda Cement Company, Ltd., Japan

[22] Filed: July 3, 1975

[21] Appl. No.: 593,168

[30] Foreign Application Priority Data

July 10, 1974 Japan ..... 49-78221

[52] U.S. Cl. ..... 239/15

[51] Int. Cl.[2] ..... B05B 5/02

[58] Field of Search ..... 239/3, 15; 118/623, 118/629; 317/3

[56] References Cited

UNITED STATES PATENTS

| | | | |
|---|---|---|---|
| 1,854,475 | 4/1932 | Littlefield | 239/3 |
| 3,521,815 | 7/1970 | Szasz | 239/15 |
| 3,550,852 | 12/1970 | Wallis | 239/15 |
| 3,735,925 | 5/1973 | Benedek | 239/15 |
| 3,872,361 | 3/1975 | Masuda | 317/3 X |

*Primary Examiner*—John J. Love

*Attorney, Agent, or Firm*—Price, Heneveld, Huizenga & Cooper

[57] ABSTRACT

Silent discharge electrodes are provided in the proximity of a powder paint injection opening to generate silent discharge between these electrodes. Thus the voltage applied between a body to be painted and a painting apparatus and the discharge current flowing from said painting apparatus to said body to be painted can be respectively regulated independently of each other, and the flow pattern of ion currents in the painting space can be appropriately regulated, whereby the painting efficiency is enhanced and the quality of the painted film is improved.

9 Claims, 12 Drawing Figures

POWDER PAINTING APPARATUS

Figure 1:
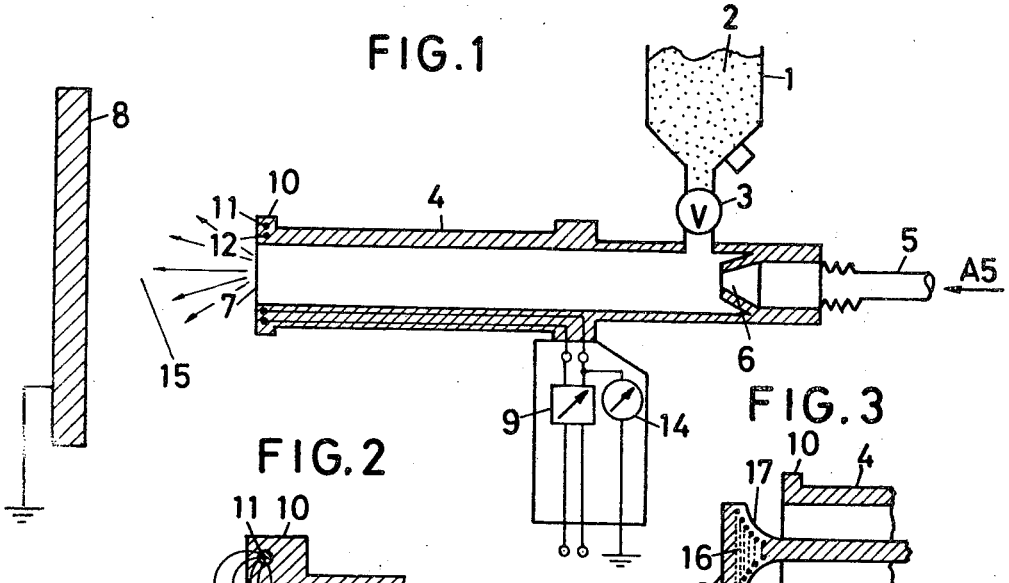

The present invention relates in general to improvements in an electrostatic powder painting apparatus, and more particularly, to improvements in the heretofore known electrostatic powder painting apparatus, which operate according to the basic principle that paint powders injected from a powder paint injection opening as dispersed by air or other gas are charged by applying a high voltage to a needle or knife edge shape of electrodes disposed in the proximity of the powder paint injection opening to utilize a corona discharge generated at these electrodes, and that by the action of a high intensity electric field existing between these electrodes and a body to be painted the charged paint powders are attracted to the body to be painted and thus adhered onto the surface of said body to be painted.

However, at present these heretofore known powder painting apparatuses have great basic shortcomings as described hereinunder, so that the efficiency of the powder painting is limited to a low value and yet it is impossible to obtain a powder paint layer having a sufficiently excellent nature. The cause of the shortcomings will be now explained. A first one of the shortcomings of the electrostatic powder painting apparatus is that the values of the voltage applied to the apparatus and the current flowing from the apparatus cannot be controlled independently of each other. More particularly, in such type of powder painting apparatuses, if the voltage applied to the painting apparatus is given, then the value of the current flowing from the painting apparatus to the body to be painted is determined uniquely. However, electric properties such as an electric resistance of powders used for powder painting are varied over an extremely wide range. with respect to a particular paint powder also, the value of its electric resistance varies over a very large range depending upon the state of preservation, the composition of the working gas and/or the temperature. Generally speaking, in case that it is desired to paint thickly a powder having a very high electric resistance, then it is required to use a voltage as high as possible for the applied voltage with a discharge current as small as possible. On the contrary, in case that the electric resistance of the paint is low, then the property of the obtained powder layer is more preferable and more compact when a larger current is passed and the applied voltage is relatively lower. However, in the conventional type of electrostatic powder painting apparatus such requirement is not satisfied, because if one tries to obtain a large current then necessarily the applied voltage must be chosen high, while if the current is reduced then the applied voltage is necessarily lowered, and therefore, it was practically very difficult to effectively perform painting with powders having an extremely high electric resistance or with powders having a relatively low electric resistance. The above-mentioned was the first shortcoming of the conventional powder painting apparatus.

Generally in an electrostatic powder painting apparatus, in case that an electric resistance of the powders is very high, owing to a voltage drop across a powder layer adhered onto a body to be painted that was caused by an ion current coming from the electrostatic powder painting apparatus, the so-called inverse ionization phenomenon occurs within the adhered powder layer, and consequently the powder layer peels off in a spotted form, resulting in pin holes and the like. This phenomenon is more apt to occur as the powder paint layer becomes thicker and as the density of the current flowing through the powder layer becomes larger. Accordingly, in case that an electric resistance of powders is very high, it is required to maintain the value of the current passed upon painting from the powder painting apparatus to the body to be painted as small as possible. However, in case that the current flowing from the painting apparatus to the body to be painted is provided by corona discharge as described above, as an inherent nature of corona discharge the discharge would become unstable if the discharge current is very small, that is, if the corona discharge electrode is kept at a potential near to an ignition potential. Therefore, the conventional electrostatic powder painting apparatuses had shortcomings in that if it is intended to maintain the discharge stable then the current becomes too large resulting in deterioration of adhesion of the powder layer, while on the contrary if it is intended to reduce the discharge current to improve the property of the powder layer then the voltage is lowered and the electric fields are weakened, so that the adhesion of the powders is degraded and it becomes difficult to obtain a thick layer of the powders, and in addition, that control of the painting process becomes extremely difficult because the discharge current is very unstable.

A second shortcoming found in the conventional electrostatic powder painting apparatus is the following. Since discharge electrodes of very sharp shape such as needle-shaped electrodes, linear electrodes, knife-edge-shaped electrodes, etc., are employed for effectively charging powders, when the powders adhere to such portions the discharge characteristics are greatly varied, so that in order to maintain the characteristics always at appropriate values it is required to often interrupt the painting work for cleaning the discharge electrodes of the painting apparatus. The adhesion of the powders onto the discharge electrodes would necessarily occur owing to concentration of electric fields at the discharge electrodes, so that it is impossible, in principle, to essentially prevent this phenomenon. Accordingly, in the case of the conventional electrostatic powder painting apparatuses, it was impossible to provide a powder paint layer having an always stable quality on a body to be painted. This is a second significant shortcoming of the conventional electrostatic powder painting apparatuses.

In a certain type of electrostatic powder painting apparatuses, at a foremost central portion of the powder paint injection opening is provided a dispersion plate for appropriately dispersing a mixture of gas and powder paint in the directions matched to the shape of the body to be painted. In such type of electrostatic powder painting apparatus, sometimes the injected paint accumulates on the dispersion plate resulting in change of the shape of the dispersion plate, so that the condition of dispersion of the powder paint would vary and thus it becomes impossible to maintain a desired painting condition. This is a third shortcoming of the heretofore existing electrostatic powder painting apparatuses.

In addition, in the conventional electrostatic powder painting apparatuses, charging of powders cannot be achieved sufficiently, and consequently, it is difficult to obtain a high painting adhesion efficiency. This is caused by the fact that the region in which powders are charged is limited because of the utilization of corona discharge for charging of the powders, and that in this region, because the density of the powders is necessarily enriched, it is impossible to sufficiently charge the powders. On the other hand, as described previously, if it is intended to charge powders in the region where the powders have been dispersed, then the current density of the current flowing from the apparatus to the body to be painted is increased, and this becomes a great hindrance especially in case that the electric resistance of the powders is high and it degrades the painting adhesion of the powders onto the body to be painted. In summary, the conventional powder painting apparatuses have a great disadvantage that the paint adhesion efficiency is low because of the very low charging efficiency of the powders. This is a fourth shortcoming of the electrostatic powder painting apparatus in the prior art.

A fifth shortcoming of the conventional electrostatic powder painting apparatuses is that in case of painting with powders having an extremely low electric resistance various difficult problems would occur. More particularly, in case of painting with electrostatic powder paint containing much metallic powders, a spark is apt to occur from an electrode of the powder painting apparatus. This often induces a great accident such as explosion of the powders or the like, and this was considered as a large shoftcoming of the electrostatic powder painting apparatus in the prior art.

Therefore, it is a principal object of the present invention to provide a very excellent electrostatic powder painting apparatus, which eliminates all of the above-described various shortcomings of the electrostatic powder painting apparatuses in the prior art, which can apply a very good powder layer onto the body to be painted, which can form a powder layer having a desired thickness onto the body to be painted in accordance with the properties of the powders, which can obtain a powder layer having stable properties, which has an extremely high painting adhesion efficiency, and which has no risk of generating spark discharge even in case of painting with low resistance powders.

Another object of the present invention is to provide an electrostatic powder painting apparatus, in which in accordance with the properties such as an electric resistance or the like of the powders employed for the electrostatic powder painting, the magnitude of the electric current flowing from the painting apparatus towards a body to be painted can be varied independently of the voltage applied therebetween.

Still another of the present invention is to provide an electrostatic powder painting apparatus, in which adhesion of the powders to discharge electrodes can be prevented.

Yet another object of the present invention is to provide an electric powder painting apparatus, in which the wasteful flow towards the body to be painted of the electric current for charging the powders can be prevented and also various difficulties caused by the wasteful electric current can be obviated.

According to one feature of the present invention, there is provided an electrostatic powder painting apparatus in which in the proximity of a powder paint injection opening are disposed one or more pairs of silent discharge electrodes, at least one electrode of each electrode pair being covered by an insulator, a voltage source for applying an A.C. voltage is connected to the electrode pair or pairs, and another voltage source is connected across these silent discharge electrode pairs and the body to be painted for generating a potential difference therebetween.

Figure 2:
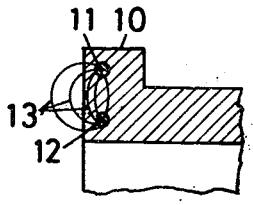
Figure 3:
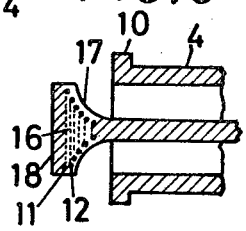
Figure 4:
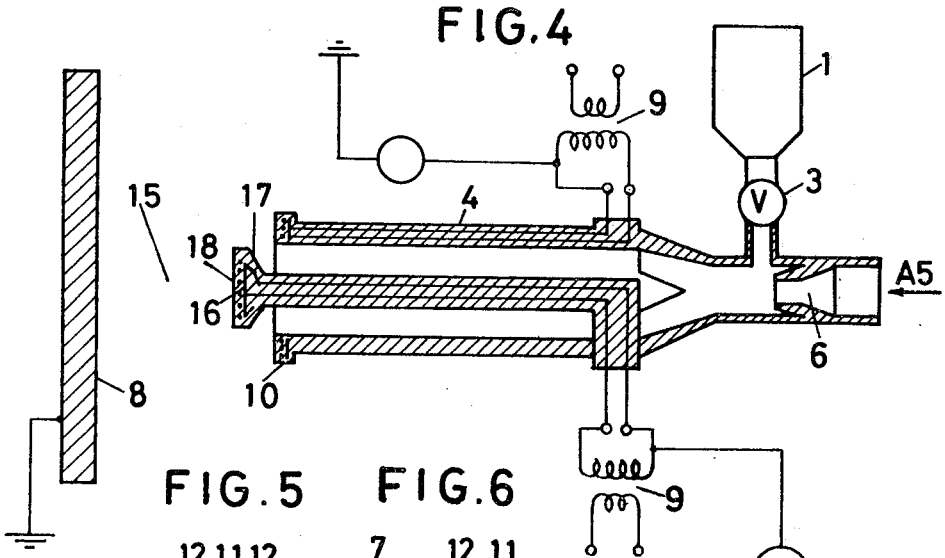
Figure 5:
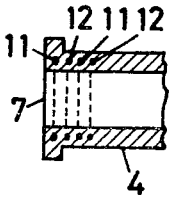
Figure 6:
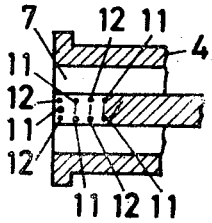
Figure 7:
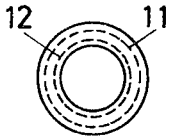
Figure 9:
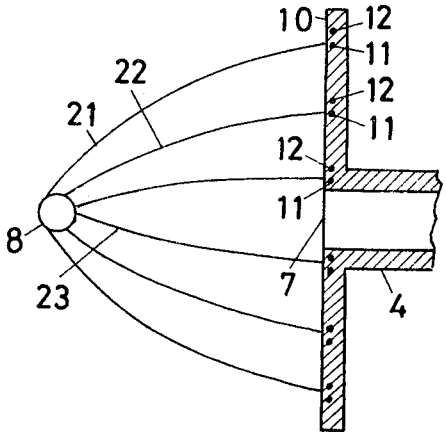
Figure 8:
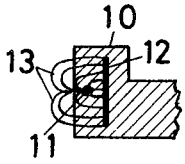
Figure 10:
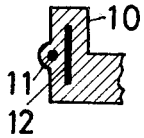
Figure 11:
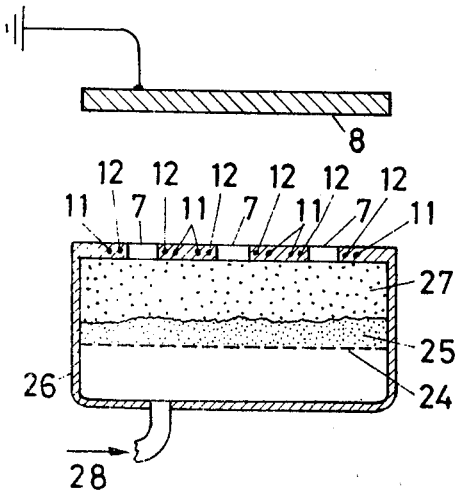
Figure 12:
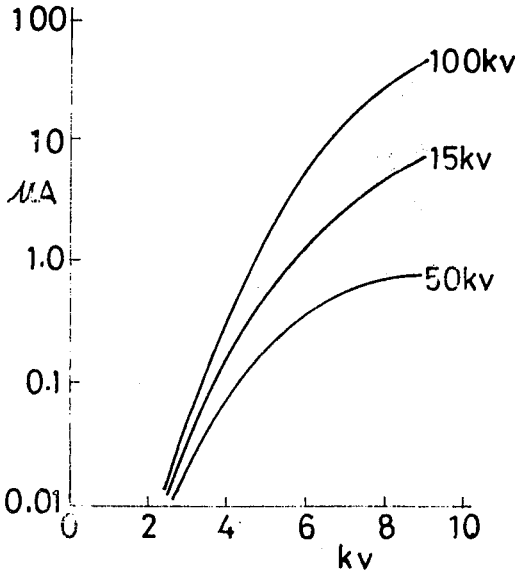

These and other features and objects of this invention will be more fully understood by reference to the following description taken in conjunction with the accompanying drawings which illustrate a number of preferred embodiments of the present invention, in which:

FIG. 1 is a longitudinal cross-section view of one preferred embodiment of the invention, FIG. 2 is an enlarged partial cross-section view of a part of the apparatus shown in FIG. 1, FIGS. 3 and 4 are cross-section views similar to FIGS. 2 and 1, respectively, showing another preferred embodiment of the invention, FIGS. 5 and 6 are enlarged cross-section views similar to FIG. 3 of still further preferred embodiments of the invention, FIG. 7 is a left end view of a part of the apparatus shown in FIG. 1, FIGS. 8 and 10 are enlarged partial cross-section views similar to FIG. 2 of yet further preferred embodiments of the invention, FIGS. 9 and 11 are enlarged partial cross-section views showing still further preferred embodiments of the invention, and FIG. 12 is a diagram showing variation curves of a current flowing between a painting apparatus and a body to be painted as a function of a voltage applied between a pair of silent discharge electrodes which is varied from 1 to 8 KV, with respect to the cases where the potential difference between the painting apparatus and the body to be painted takes specific values of 15 KV, 50 KV and 100 KV.

Now referring to the drawings, in FIG. 1 paint powders stored in a hopper 1 are fed into a nozzle 4 of a painting apparatus via a valve 3, while air supplied from an air supply pipe 5 in the direction of an arrow A5 passes through an ejector 6, and after converted into a high speed flow it is injected from a paint injection opening 7 towards a body 8 to be painted in a state of suspending said powders. In this embodiment, in the proximity of the powder paint injection opening 7, electrodes 11 and 12 consisting of concentric circular thin wires are embedded in a ring-shaped insulator layer 10 at its shallow depth as viewed from its surface opposed to the body 8 to be painted. To this silent discharge electrode pair 11 and 12 is applied an A.C. voltage from a voltage source 9, and as a result between the electrodes 11 and 12 are established A.C. electric lines of force 13 as shown in the enlarged detail view of FIG. 2. If the number of these A.C. electric lines of force 13, that is, the electric field intensity becomes larger than the spark voltage of the gas existing on the surface of the ring-shaped insulator layer 10, then silent discharge occurs at this location and positive and negative ions become to exist there. Accordingly, when a D.C. electric field, for example, is established between the body 8 to be painted and these electrodes 11 and 12 by means of a voltage source 14 as shown in FIG. 1 owing to the electric field established there by the voltage source 14 extending from the silent discharge region 13 established in front of the ring-shaped insulator layer 10, mono-polar ions having a predetermined polarity flow as an ion current from the front surface of the ring-shaped insulator layer 10 towards the body 8 to be painted. These ions in the ion current combine with powder particles floating within the space 21 between the body 8 to be painted and the ring-shaped insulator layer 10 and make the powders charged, and as a result, the charged powders are attracted to the body 8 to be painted by the action of the electric field established between the ring-shaped insulator layer 10 and the body 8 to be painted and thus form a powder paint layer on the body 8.

In the electrostatic powder painting apparatus having a basic structure as described above, in case that the strength of the electric field established between the ring-shaped insulator layer 10 and the body 8 to be painted is kept constant, since the strength of the silent discharge produced in the silent discharge region 13 in front of the ring-shaped insulator layer 10 can be regulated by adjusting the A.C. voltage applied by the voltage source 9, the intensity of the ion current flowing from the tip end of the electrostatic powder painting apparatus, that is, the ring-shaped insulator layer 10 towards the body 8 to be painted can be regulated over a wide range by such adjustment even if the electric field established between the ring-shaped layer 10 and the body 8 to be painted. Since the aforementioned relationship is always satisfied even if the strength of the electric field produced between the ring-shaped insulator layer 10 and the body 8 to be painted by the voltage source 14 should vary over a considerably wide range, in the electrostatic powder painting apparatus according to the present invention it becomes possible to freely regulate the intensity of the current flowing through the painting space 15 independently of the strength of the electric field established in the painting space 15. Therefore, in the electrostatic powder painting apparatus according to the present invention, it is also possible to stably feed a current of low current density under a very strong electric field strength as required in case of painting with powders having a very high electric resistance. On the contrary, even under a weak electric field strength, it is possible to pass a heavy current by selecting a high value of the A.C. voltage applied by the voltage source 9, and in this way it becomes possible to freely satisfy the conditions for the current and voltage required for every kind of electrostatic powder painting. This is the first essential feature of the electrostatic powder painting apparatus according to the present invention.

Nextly, it is to be noted that as will be obvious from FIG. 2 the electric lines of force 13 established in front of the ring-shaped insulator layer 10 between the electrodes 11 and 12 embedded in the shallow surface portion of the layer are always outwardly convex. In addition, these electric lines of force 13 alter their direction for every half period of the A.C. voltage source 9. Accordingly, the charged powders existing in front of the ring-shaped insulator layer 10 are always subjected to a repulsive force in the direction of moving away from the ring-shaped insulator layer 10 as a centrifugal force caused by an alternating motion along these electric lines of force. Therefore, in front of the ring-shaped insulator layer 10 the powders would never adhere onto the discharge electrodes, so that the voltage-current characteristics of the painting apparatus would not be varied by adhesion of powders at all as is the case with the electrodes of the conventional electrostatic powder painting apparatus utilizing a corona discharge, and thus it is possible to always maintain a stable performance. This is the second significant feature of the present invention.

The silent discharge electrodes according to the present invention is applicable to an electrostatic powder apparatus in which a dispersion plate is disposed in front of a powder injection opening 7. In this case, by embedding a large number of silent discharge electrodes 11 and 12 in a mushroom shape of dispersion plate 16 on its inner side opposed to the ring-shaped insulator layer 10 as shown in FIG. 3, adhesion of powders onto a surface 17 on the side where the powders collide can be prevented owing to outwardly convex electric lines of force established in the proximity of the surface 17, and thereby it becomes possible to maintain the function of the dispersion plate 16 always stable. In this embodiment, in some cases silent discharge electrodes are embedded in the ring-shaped insulator layer 10, while in other cases they are not embedded. Also, as shown in FIG. 4, it is also possible to embed silent discharge electrodes in the dispersion plate 16 along the surface 18 opposed to the body 8 to be painted and along the surface that is parallel to the direction of travelling of the powders, too, for preventing the powders from adhering onto these surfaces, and for extracting monopolar ions from these surfaces of the dispersion plate and passing these ions through the discharge space 15, and thereby to achieve charging of the injected powders more effectively. As described, in the electrostatic powder painting apparatus according to the present invention, it is possible to maintain the function of the dispersion plate 16 always stable for a long period of time, and further, charging of the injected powders can be achieved effectively by generating monopolar ions from the dispersion plate 16, too, whereby it becomes possible to obtain an extremely high painting adhesion efficiency. This is the third remarkable feature of the electrostatic powder painting apparatus according to the present invention.

The silent discharge electrode pairs of the electrostatic powder painting apparatus according to the present invention are not limited to the disposition only along the surface opposed to the body 8 to be painted as shown in FIG. 1, but also they could be disposed on the inside of the powder injection opening 7 as shown in FIG. 5. Or else, it is also possible to form the powder injection opening 7 in a ring shape and to embed the silent discharge electrode pairs 11 and 12 in a shaft inside of the opening 7 along the outer peripheral surface of the shaft as shown in FIG. 6. By employing such an arrangement, the powders passing through the injection opening can be charged strongly while they are yet inside of the injection opening, so that the charged condition of the powders can be extremely improved. Consequently, the painting adhesion efficiency can be enhanced, and this is the fourth feature of the present invention.

The silent discharge electrode pairs disposed inside of the injection opening can be constructed as a combination of the electrode pairs shown in FIGS. 5 and 6, respectively, such that the silent discharge electrode pairs are disposed on the inner and outer circumferences of the ring-shaped powder injection opening as opposed to each other. In case that the silent discharge electrode pairs are disposed in the above-described manner and the D.C. voltages applied to the respective electrode pairs have been adjusted so that D.C. potential differences may appear therebetween, monopolar ions would flow through the space between the silent discharge electrodes located in the proximity of the powder paint injection opening as opposed to each other, so that the powders are charged very strongly, and thereby the painting adhesion efficiency can be improved widely. As a similar phenomenon, in casethat a D.C. potential difference is provided between silent discharge electrode pairs existing along the surface 17 of the dispersion plate 16 shown in FIG. 4 and the silent discharge electrode pairs existing in the ring-shaped insulator layer 10, monopolar ions flow from the surface 17 towards the surface of the ring-shaped insulator layer 10 and thereby the powders passing through the space between these surfaces are very strongly charged, so that in such a case also an extremely high painting adhesion efficiency can be obtained. In this way, the silent discharge electrode pairs located in the proximity of the powder injection opening are divided into two groups, a monopolar ion current is made to flow by providing a D.C. potential difference between these groups, whereby the powders are strongly charged in the proximity of the paint injection opening. Furthermore, a wasteful current is prevented from flowing to the body to be painted by preventing the current used for charging from flowing into the painting space 21, and accordingly, various difficulties caused by the flow of a wasteful current into the body to be painted can be prevented so that a very high painting adhesion efficiency can be obtained. This is the fifth big feature of the present invention.

Every one of the silent discharge electrode pairs illustrated in FIGS. 1 through 8 is embedded within an insulator without exposing the electrode conductors, so that even if powders having a low electric resistance have passed thereby, production of sparks can be suppressed, and accordingly, it is possible to provisionally prevent accidents in powder painting such as ignition of the powder paint or generation of sparks. This is the sixth large feature of the present invention.

As will be obvious from the above explanation, because the silent discharge electrode pairs in the electrostatic powder painting apparatus according to the present invention can freely generate ion currents at a flat portion on the surface of an insulator, the freedom upon designing the configuration of the discharge electrodes is very large, and so, besides the aforementioned electrode structures, formation of a very wide range of electrode structures can be realized depending upon the shape of the body to be painted and other factors. Illustration of one example of such modifications is given in FIG. 9. That is, in the illustrated modified embodiment of the present invention, around a paint injection opening 7 is mounted a large disc-shaped insulator layer 10 as opposed to a body 8 to be painted, and in this disc-shaped insulator layer 10 are embedded three pairs of silent discharge electrodes arranged on concentric circles at shallow portions along its surface. Accordingly, when silent discharge is generated by applying an A.C. voltage to each electrode pair while making powder paint to be injected from the powder paint injection opening 7, films 21, 22 and 23 of monopolar ions forming a surface shape of a revolved body are established by the electric field produced between the disc-shaped insulator layer 10 and the body 8 to be painted. Since the paint powders injected from the paint injection opening 7 are surrounded by these ion films in a triple manner, the paint powders can hardly go out of these ion films, and thus it becomes possible to obtain a very high painting adhesion efficiency. The above-mentioned is no more than an illustration of one example of special electrostatic powder painting apparatus according to one preferred embodiment of the present invention, and the electrostatic powder painting apparatus according to the present invention can be designed very freely depending upon the method of disposing the discharge electrode pairs, and this big feature is the sixth feature of the present invention.

With regard to the silent discharge electrode pair employed according to the present invention, the arrangement such that thin linear electrodes disposed near to and in parallel to each other are embedded in a shallow surface portion of a layer type insulator as shown in FIG. 2 and an A.C. voltage is applied therebetween, is the basic form. However, besides various silent discharge electrode pairs can be constructed. As one example of the modified embodiments, a thin linear electrode 11 is embedded in a insulator layer at a portion near to its surface, while a planar electrode 12 is embedded at a deep portion as shown in FIG. 8, and by applying an A.C. voltage between these electrodes it is possible to establish electric lines of force 13 curved in an outwardly convex manner on the surface of the insulator layer 10. It is a matter of course that the silent discharge generated along these electric lines of force can be utilized for generation of ion currents. In addition, a modified arrangement of that shown in FIG. 8, in which the surface portion of the insulator layer 10 just above the linear electrode 11 is projected in a ridge form as shown in FIG. 10, is also practically available. Still further, even in case that one of the thin linear electrodes opposed to each other along the surface of the insulator layer is exposed, it is possible to use them as a silent discharge electrode pair for producing ion currents. However, if one of the linear electrodes is exposed, then it becomes necessary to provide a guard resistance between the electrodes and a voltage source therefor to guard the electrodes upon occurrence of spark discharge. Practically, an especially significant advantage would not be obtained by exposing either one of the electrodes out of the surface.

With regard to the method of conveying the powder paint up to the paint injection opening for injecting the powder paint from the paint injection opening in the electrostatic powder painting apparatus according to the present invention, any desired method can be employed. While, in the above description, with respect to the method of conveying the powder paint up to the paint injection opening, only the commonly used method of conveying the powder paint by means of a pressurized gas has been described, alternatively it is, of course, possible to use the method of conveying preliminarily charged powders without being accompanied by a gas by making use of a transport capability of the so-called travelling wave type of alternating electric fields. Otherwise, it is also possible to provide a box containing fluidized powder paint on the rear side of the powder injection opening and to directly inject the powders floating within this box as mixed with a gas through the paint injection opening for achieving painting. Such an embodiment is especially effective in case that powder paint is injected not only through a single injection opening but simultaneously through a plurality of paint injection openings for painting a broad surface at a high speed. In such cases, since the silent discharge electrode pairs according to the present invention can be easily provided in the proximity of each of the plurality of paint injection openings, the effectiveness of the present invention is further remarkably revealed. In this connection, one mode of the preferred embodiment is illustrated in FIG. 11. More particularly, in FIG. 11, an air flow for fluidizing and conveying paint powders that is passed in the direction of an arrow 28 through a layer of powders 25 fed on the upper surface of a dispersion plate 24, is supplied to the electrostatic powder painting apparatus through a wind box 26. As a result, the powders are injected through a plurality of injection openings 7 as mixed with air within a space 27 into a floating condition. Since silent discharge electrode pairs 11 and 12 are disposed in the proximity of the respective injection openings as shown in FIG. 11, if the apparatus is constructed in such manner, then it is possible to paint a broad surface of a planar body 8 to be painted at a uniform thickness substantially in a moment.

In connection to one preferred embodiment of the present invention, detailed numerical data will be described hereinunder. In an electrostatic powder painting apparatus according to the present invention that was constructed in the type shown in FIG. 1, with a diameter of the paint injection opening 7 of 15 mm and a feeding rate of the powders of 500 gr per minute, conductor electrodes 11 and 12 of 0.2 mm in diameter are disposed on concentric circles separated by an interval of 3 mm at a depth of 0.5 mm as measured from the surface of the ring-shaped insulator layer 10, and the distance between the body 8 to be painted and the ring-shaped insulator layer 10 is kept at 30 cm. Then, the voltage-current characteristics obtained are as shown in FIG. 12, in which the parameters associated with the respective curves represent the voltages applied between the body to be painted and the tip end of the painting apparatus. In FIG. 12 the numerals indicated along the ordinate represent the magnitude of the ion current flowing from the painting apparatus to the body to be painted, while the numerals indicated along the abscissa represent the magnitude of the A.C. voltage applied across the silent discharge electrode pair. The frequency of the A.C. voltage employed was 50 Hz. As will be obvious from FIG. 12, when the A.C. voltage applied across the silent discharge electrode pair is varied from 1 to 8 KV, with respect to the current and potential difference existing between the painting apparatus and the body to be painted, it is possible to arbitrarily select an extremely wide range of voltage-current characteristics as shown in the figure.

Therefore, upon operating the apparatus of the present invention, in case of painting a metallic plate 8 of 20 × 20 cm in size with epoxy resin powder paint having a body specific resistance of $10^{13}$ Ω·cm that has been preliminarily charged by a charging device not shown, if an A.C. voltage of 4 KV is applied across the silent discharge electrode pair and if a potential difference of 100 KV is applied between the powder painting apparatus and the body to be painted, then it is possible to obtain a thick compact paint film that is 400 microns in thickness after baked and that is free from pin holes. This is caused by the fact that because a very low level of current of about 0.3 micro-amperes can be realized uniformly over the entire surface of the body to be painted regardless of the extremely high electric field strength then selected, these never occurs inverse ionization within the powder layer, and accordingly a compact paint film can be obtained stably even if the paint film is made thick. In the conventional electrostatic powder painting apparatus, in case of painting with powder paint having such very high specific resistance, it was the upper limit to obtain a paint film thickness of the order of 200 microns, and it was impossible to obtain a thicker paint film.

What is claimed is:

1. An electrostatic powder painting apparatus including a powder paint injection opening to be disposed in opposed relationship to a body to be painted, characterized by the provision of:

a pair of generally concentric spaced ring-shaped electrodes disposed in said apparatus in a generally common plane and in the proximity of and surrounding said powder paint injection opening and facing a body to be painted, said electrodes insulated from each other by an insulator covering at least one of said pair of electrodes, first power supply means coupled to said pair of electrodes for applying a relatively high A.C. voltage across said pair of electrodes to generate a silent discharge across said electrodes for the charging of particles passing from said injection opening, and second power supply means coupled between said pair of electrodes and a body to be painted for applying a potential difference between said pair of electrodes and said body to be painted.

2. A powder painting apparatus as claimed in claim 1, further characterized in that said apparatus includes a ring-shaped insulator layer provided at a tip end of said powder paint injection opening and said pair of ring-shaped electrodes is embedded in said ring-shaped insulator layer in the proximity of the surface of said insulator layer.

3. A powder painting apparatus as claimed in claim 1, further characterized in that said apparatus includes a nozzle and a dispersion plate of mushroom shape disposed coaxially with said nozzle along its center axis to define said injection opening.

4. A powder painting apparatus as defined in claim 3, wherein said dispersion plate of mushroom shape includes a pair of ring-shaped electrodes disposed in the proximity of the surface of said dispersion plate.

5. A powder painting apparatus as claimed in claim 1, further characterized in that said pair of electrodes consist of a linear electrode and a planar electrode, wherein said linear electrode is disposed on the side of a body to be painted and opposed thereto.

6. A powder painting apparatus as claimed in claim 1, further characterized in that said apparatus includes a disc-shaped insulator layer and said pair of electrodes are embedded in said disc-shaped insulator layer and said injection opening is formed at the center of said disc-shaped insulator layer.

7. A powder painting apparatus as claimed in claim 1 further characterized in that said apparatus includes a powder paint box which contains fluidized powder paint and said box includes a plurality of paint injection openings formed through a wall of said box and wherein each of said injection openings is surrounded by a pair of spaced ring-shaped electrodes.

8. An electrostatic powder painting apparatus in which a powder paint injection opening in a body to be painted are disposed in opposed relationship comprising:

a nozzle having a powder injection opening, a pair of ring-shaped electrodes extending around said injection opening and positioned only adjacent said injection opening, and insulated with respect to one another by a relatively thin insulator covering at least one of said pair of electrodes, a source of relatively high voltage alternating current power coupled to said pair of ring-shaped electrodes for providing a silent discharge between said electrodes to charge particles passing from said injection opening, and a direct voltage source coupled between a work piece and said ring-shaped electrodes for applying an electrical field between said ring-shaped electrodes and a work piece which is independent of the discharge field provided by said alternating current source.

9. An electrostatic powder painting apparatus including a powder paint injection opening to be disposed in opposed relationship to a body to be painted, characterized by the provision of:

a pair of electrodes disposed in said apparatus in the proximity of said powder paint injection opening on the exterior of said apparatus and insulated from each other by an insulator covering at least one of said pair of electrodes.

first power supply means coupled to said pair of electrodes for applying a relatively high A.C. voltage across said pair of electrodes for generating a silent discharge between said electrodes to charge particles passing from said injection opening, and second power supply means coupled between said pair of electrodes and a body to be painted for applying a direct voltage potential difference between said pair of electrodes and said body to be painted to attract charged particles to the body.

* * * * *